US005213370A

United States Patent [19]

Hood

[11] Patent Number: 5,213,370

[45] Date of Patent: May 25, 1993

[54] EXPANDABLE LOOSE-LEAF VOLUME

[76] Inventor: Judy M. Hood, 14345 Saddle Mountain Dr., Los Altos Hills, Calif. 94022

[21] Appl. No.: 855,244

[22] Filed: Mar. 23, 1992

[51] Int. Cl.[5] ..... B42D 3/00

[52] U.S. Cl. ..... 281/36; 281/29; 402/55; 402/74

[58] Field of Search ..... 281/15.1, 19.1, 21.1, 281/28, 29, 35, 36; 402/73, 74, 75, 55

[56] References Cited

U.S. PATENT DOCUMENTS

| | | | |
|---|---|---|---|
| 2,784,719 | 3/1957 | Panfil | 402/74 |
| 3,098,487 | 7/1963 | Fenston | 402/74 |
| 3,734,634 | 5/1973 | Fenston | 402/74 |
| 3,837,680 | 9/1974 | Cimini | 281/29 X |
| 3,972,632 | 8/1976 | Carter | 281/29 X |
| 4,284,227 | 8/1981 | Corey | 281/29 |

*Primary Examiner*—Timothy V. Eley
*Assistant Examiner*—Willmon Fridie, Jr.
*Attorney, Agent, or Firm*—James J. Leary

[57] ABSTRACT

An expandable capacity album or binder for storing and displaying artwork or photographs retains the appearance of a library bound hardcover book at any state of expansion. The front cover and back cover are hinged to a spine which has page retaining channels that allow looseleaf pages to be inserted into or removed from the album. Together, the spine and the channels are adjustable so that the album will expand and contract for different capacities. The outside of the album is covered with leather or cloth to give the album the appearance of a library bound hardcover book. In between the spine and the covering is a resilient material such as plastic foam which can compress or expand so that the covering will always look properly fitted to the spine even when the spine is expanded or contracted to change the capacity of the album. In this way the album maintains its library bound appearance at any state of expansion. Additionally, there may be a layer of fibrous batting or other padding between the resilient material and the covering which may also extend between the covering and the front and back covers, giving the spine and the covers a high quality padded look and feel.

20 Claims, 7 Drawing Sheets

EXPANDABLE LOOSE-LEAF VOLUME

FIELD OF THE INVENTION

This invention relates to albums or binders for the storage and display of material, such as artwork or photographs. More particularly, it relates to an album with expandable capacity that has the appearance of a bound book at any state of expansion.

BACKGROUND OF THE INVENTION AND DISCUSSION OF THE PRIOR ART

A very important aspect of the present invention is that it provides an expandable spine for a volume for use as an album or binder that has the external appearance of a bound book. The spine of a bound book is characterized by a continuous, unbroken surface across the back of the binding. Different styles of book bindings are marked by different stylistic details, such as the raised ribs across the back of a hand-sewn flexible binding or the French grooves at the joint between the spine and covers of a library bound book. However, all of these styles share the unifying characteristic of a continuous, unbroken surface across the back of the binding. There are no assembly joints or exposed hardware on the spine of a book to mar its appearance. This bound book appearance is desirable for albums and binders because it offers the most aesthetic presentation for the materials contained. This aspect is especially important for the displaying of valuable artwork or photographs with great sentimental value such as wedding photographs where anything less than a high quality bound book appearance would detract from the presentation. The bound book appearance would also be important for binders or albums used as "coffee table books" which are used to display artwork, prints or photographs in people's homes. The desirability of this feature should be kept in mind while reading the following discussion of the prior art.

LOOSE-LEAF PHOTOGRAPH ALBUMS—Albums and binders for storing and displaying materials, such as artwork, photographs or memorabilia, are well known. One style of professional photograph album constitutes a loose-leaf binder with individual photo-holding pages having hinge rods that are inserted into hinge retainers on the spine of the binder. The individual pages may be removed from the album for separate mounting of the photographs, then the pages may be replaced by reinserting the hinge rods into the hinge retainers. Many variations of this concept have been patented. U.S. Pat. No. 1,399,016 to Jones shows an album of this type where the hinge rods of the loose-leaf pages have heads that may be inserted or removed through key slots in the hinge retainers. U.S. Pat. No. 1,279,673 to Dobersch discloses an album wherein the hinge rods are inserted into grooves in the hinge retainers through an entrance in the side of the retainer. The entrance to the groove can be closed by a hasp or other closure means. U.S. Pat. No. 3,469,333 to Roberts describes an album with special photo-holding pages that may be inserted into the slotted hinge retainers by bending the hinge rods. U.S. Pat. No. 4,993,750 to Hoffmeister and Holson describes an album of the same general type in several embodiments that have different closures incorporated into the hinge retainers so that the hinge rods can be inserted without bending them.

Loose-leaf albums such as these may be constructed in such a way that on the exterior they resemble a bound book. However, a distinct disadvantage of these prior art albums is that they are made to contain a specific number of pages. If the user wishes to add more pages, the album must be replaced with one of greater capacity. Besides the inconvenience to the user, this inflexibility also presents an inconvenience to the manufacturer and the seller in that they must either inventory binders with every possible increment of page capacity, or they must custom manufacture different sized albums for each customer's order. Either of these solutions causes inefficiencies in production that are likely to result in higher cost and long delays for delivery to the customer.

EXPANDABLE BINDERS—Other types of loose-leaf binders commonly used for binding printed material have expandable spines so that the capacity of the binders can be increased or decreased to match the volume of material contained. Various types of retaining means are used to hold the pages in these binders. U.S. Pat. No. 3,785,740 to Strong describes a ring binder with expandable capacity. U.S. Pat. No. 3,734,634 to Fenston describes an expandable loose-leaf binder where the pages are held by semicylindrical pins which coact to provide cylindrical posts for retaining the pages. U.S. Pat. No. 3,288,143 to Federbush et al. describes an expandable post binder that has overlapping rear flanges along the spine. All of these expandable binders share the drawback that they do not have the appearance of a bound book. On some, the screws or clamps that operate the expansion mechanism can be seen exposed on the binding. Even on high quality expandable binders where all of the hardware is hidden, the overlapping expansion joints visible on the spine reveal that it is a binder and not a bound book. This may be acceptable for the storage of journals or other printed material, but it detracts from the aesthetic appearance of the binder. This makes it less suitable for displaying valuable artwork or photographs with great sentimental value such as wedding photographs.

EXPANDABLE PHOTOGRAPH ALBUMS—A number of attempts have been made to combine the functions of loose-leaf photo albums with expandable binders. In the TAP Lock-Leaf album made by the Taprell Loomis Co., each individual page has a double hinge member which attaches it to the previous page and to the next page. Complete albums are built up by locking the desired number of pages together, then attaching front and back covers that have a single hinge member. The hinge members are completely exposed on the spine, so the finished album does not resemble a bound book. The Encore album, also from Taprell Loomis, is an expandable post bound loose-leaf photo album. An attempt is made to give the album a bound book appearance by providing it with an expanding backstrip that covers the spine. However, the bound book appearance is marred by two visible expansion joints where the backstrip inserts into the front and back covers of the album. U.S. Pat. No. 4,172,332 to Holes et al. describes an expandable loose-leaf photo album where the individual pages are held together by flexible straps that pass through U-shaped hinges on the pages. A flexible hinge cover inserts into pockets in the front and back covers. Again, the bound book appearance is marred by the visible joints where the hinge cover inserts into the front and back covers. Despite these attempts, none of the prior art has provided an expandable loose-leaf album or binder that truly has a bound book appearance.

OBJECTS AND ADVANTAGES

In accordance with the foregoing discussion, it is a principle objective of the present invention to provide a loose-leaf album or binder in which individual pages can be inserted and removed. It is also an objective to provide an album or binder with expandable capacity so that it can be expanded or contracted to match the volume of material contained. It is an overall objective of the invention to provide an expandable binder that has a bound book appearance at any state of expansion for optimal presentation of the materials contained. It is a further objective of the invention that, by providing an album with expandable capacity, that it will simplify manufacturing, inventory and delivery of albums because only a few sizes of albums will have to be supplied to accommodate all possible capacities.

One advantage of the present invention is that the content of the album can be expanded or updated at any time by adding more pages to the album without the need to substitute a larger binder for the added capacity. Another advantage is that when the capacity of the album is adjusted to match the volume of the contents, the front and back covers will be parallel to one another like the covers of a book. By contrast, most standard albums and binders will have a triangular profile if they are not filled to capacity or, worse yet, a fan-shaped profile if they are overfilled. For this reason, standard albums and binders often do not stack well or fit neatly between other books on a shelf. The present invention not only improves the appearance of the album, but also makes it more convenient, more compact and more stable for shelf storage whether it is placed upright or lying flat.

SUMMARY OF THE INVENTION

In keeping with these objectives, the present invention takes the form of an expandable spine that may be incorporated into a loose-leaf photograph album or binder. The spine has an expansion means which allows the user to increase or decrease the capacity of the spine to match the volume of the contents. A flexible material covers the spine to give it the appearance of a bound book. Between the expansion means and the flexible material is a resilient material that serves as a means to compensate for the change in width of the spine so that the flexible material remains smoothly fitted to the spine. In this way the spine maintains the appearance of a bound book at any state of expansion. An album incorporating the spine also includes a page retaining means which is attached to the spine and a front and back cover which are hinged to the spine.

DETAILED DESCRIPTION OF THE INVENTION

Figure 1:
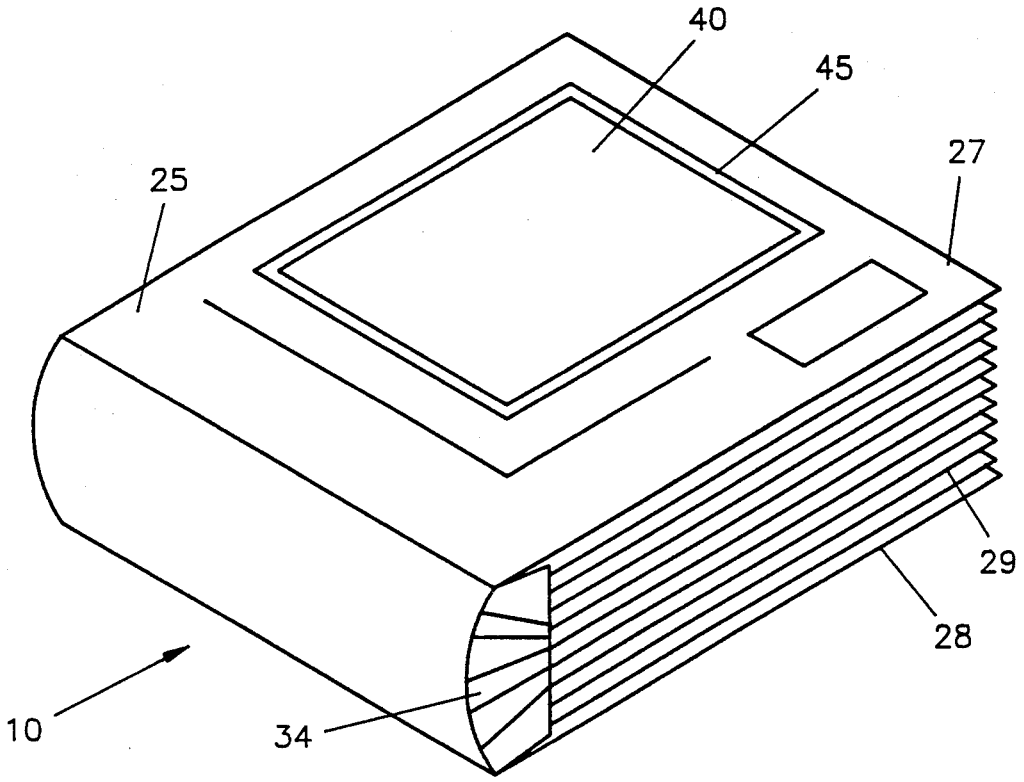
FIG. 1 is a perspective view of the expandable loose-leaf album.

The versatility of the present invention lends itself to many possible embodiments. The presently preferred embodiment of the invention takes the form of a loose-leaf photograph album with a spine that expands and contracts to change the capacity of the album to match the volume of the contents. FIG. 1 is a perspective view of an album built in accordance with the presently preferred embodiment. The album has a front cover 27 and a back cover 28 which are hinged to an expandable spine 10. The covers 27, 28 and the spine 10 are covered with a flexible material 25 that forms a smooth, continuous surface across the back of the spine 10, which gives the album the appearance of a bound book. The preferred embodiment also includes a decorative inlay 40 which is inset into the front cover 27 of the album. Decorative beading 45 borders the inlay 40 further enhancing its visual appeal. Other areas may be provided for printing names on the cover or affixing other indicia.

A plurality of individual page inserts 29 are held in the album by a page retaining means, which in this view is covered by an extension of the flexible material 25 which forms a decorative end panel 34. The width of the spine 10 can be expanded or contracted to accommodate a greater or lesser number of page inserts 29, and the spine 10 will maintain its bound book appearance.

Figure 2:
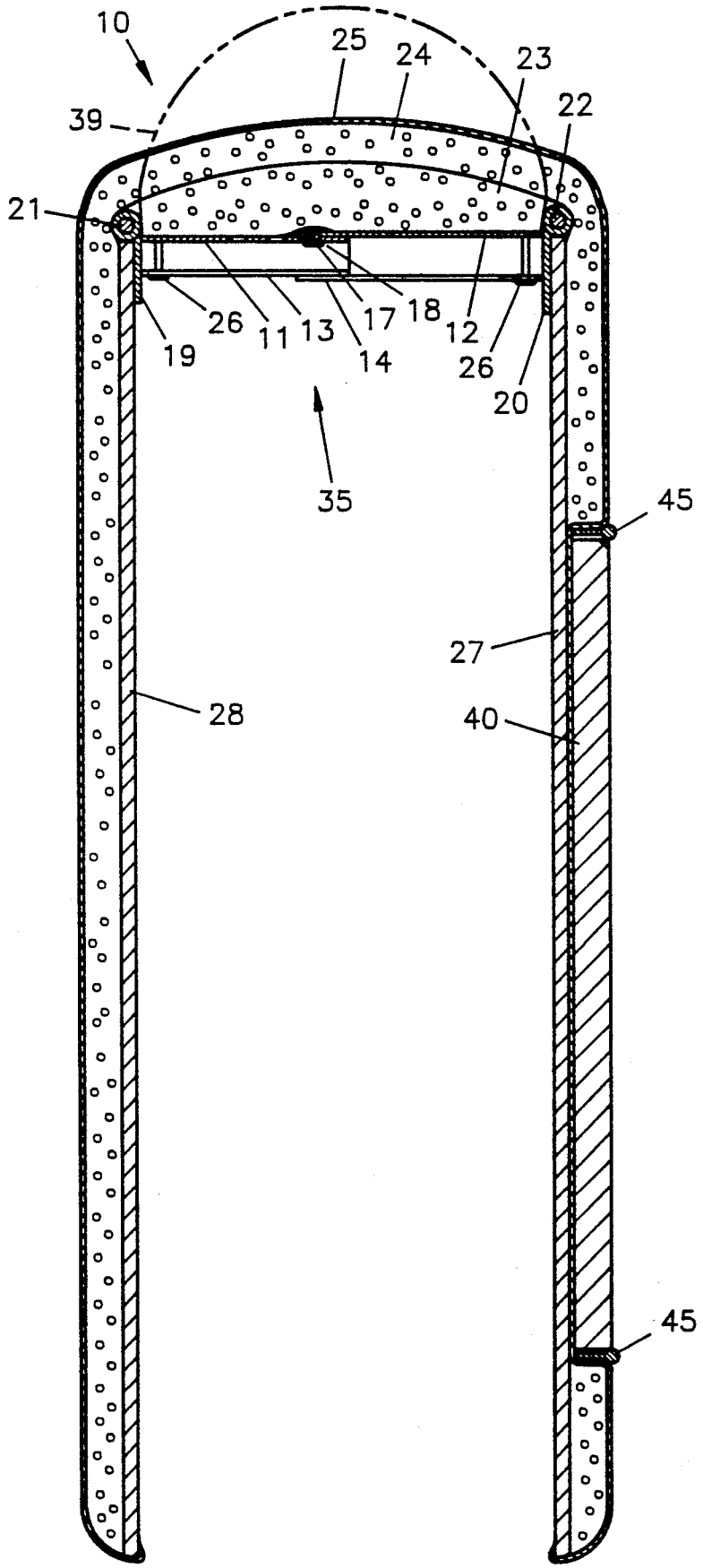
FIG. 2 shows a cross section of the album in an expanded position.
Figure 3:
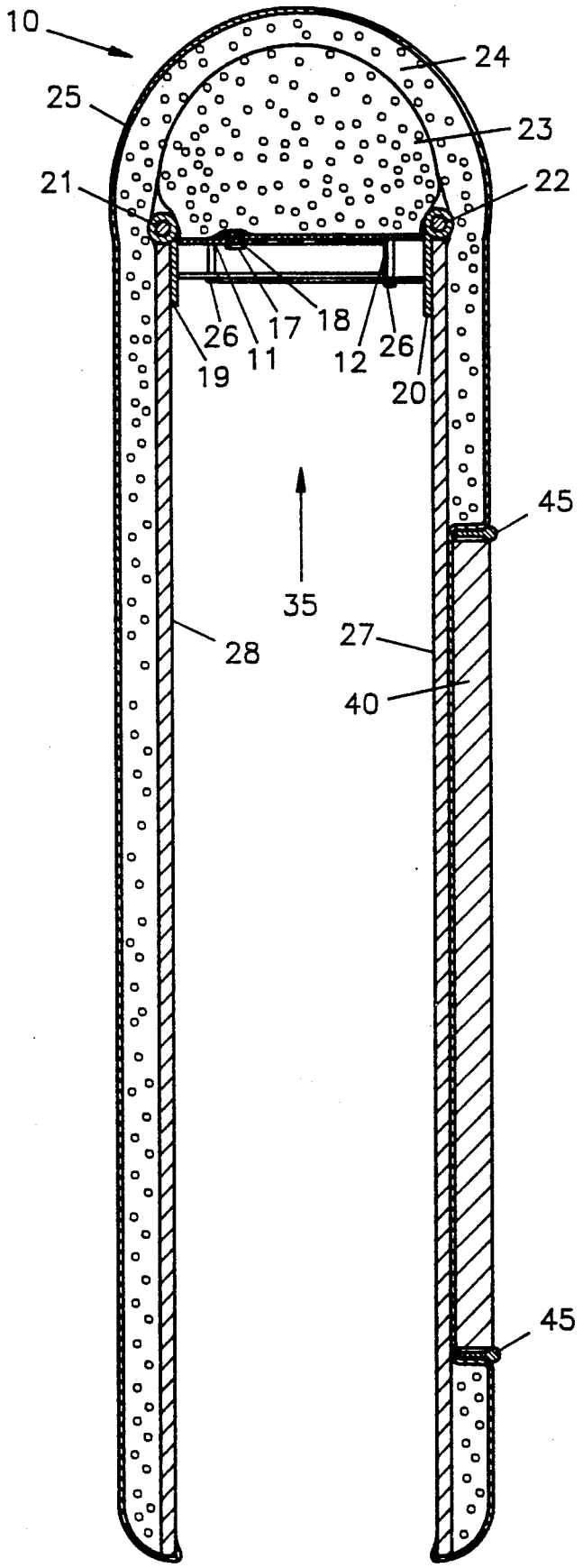
FIG. 3 shows a cross section of the album in a contracted position.

To understand the operation of the expandable spine 10, please refer to FIGS. 2 and 3 which show the album in cross section. The spine 10 is composed of two spine plates 11, 12 that move in sliding relation to one another to allow expansion of the spine 10. This arrangement allows the volume of the album to expand to almost double its original capacity. For example, in one model of this embodiment, the width of the spine can expand from $2\frac{3}{4}$ inches to 5 inches. A locking mechanism 17 holds the two spine plates 11, 12 together and prevents them from sliding once the spine 10 has been adjusted to the desired width. The locking mechanism may be one or more recessed screws 17 that fasten the two overlapping spine plates 11, 12 to one another through a series of spaced apart holes 18. The spacing of the holes 18 should be such that each incremental adjustment in the width of the spine 10 corresponds to an integral number of page inserts. Alternatively, the holes 18 may be replaced with one or more slots that allow continuous adjustment of the width of the spine 10 throughout its range. Also, a quick release mechanism, such as a camlock, may be used in place of the locking screws 17 so that the width of the spine 10 may be quickly and easily adjusted without the use of tools.

Across the back of the spine 10 is at least one layer of resilient material 23. The resilient material 23 is coextensive with the two spine plates 11, 12 when the spine 10 is at its greatest expansion, as in FIG. 2, and a covering of flexible material 25 is fitted to the spine 10 to give it the appearance of a bound book. When the width of the spine 10 is contracted, as in FIG. 3, the resilient material 23 compensates for the change in width of the spine 10, keeping the flexible material 25 taut and smooth across the back of the spine 10. Thus, the spine 10 may be expanded and contracted while maintaining the appearance of a bound book, and there is no exposed hardware or expansion joint to mar its appearance.

The preferred material for the resilient layer 23 is plastic foam, but other resilient materials such as fibrous batting, foam rubber, elastomers or even a thin spring of a polymer or metal would serve the same purpose. The preferred material for the flexible covering 25 is soft glove leather though many other woven, nonwoven and synthetic materials may be used for a different visual effect or for economic or structural reasons.

Optionally, there may also be a layer of padding material 24 such as plastic foam or fibrous batting between the resilient material 23 and the flexible material 25. If desired, the padding material 24 may also extend into the space between the flexible material 25 and the front and back covers 27, 28 to give the spine 10 and the covers 27, 28 a high quality padded look and feel.

In the preferred embodiment of the spine 10, in FIGS. 2 and 3, the resilient material is a layer of plastic foam 23 which is preshaped so that it is flat on the side facing the spine plates 11, 12 and has a convex curve on the side facing away from the spine plates 11, 12. Over the plastic foam 23 is a layer of foam or fiberfill padding 24, which in turn is covered with the flexible material 25 to form a continuous, uninterrupted surface across the back of the spine 10. The plastic foam 23 is precompressed slightly during assembly; its uncompressed shape is shown by phantom line 39 in FIG. 1. When the width of the spine 10 is contracted, as in FIG. 3, the foam 23 compresses in the direction parallel to the spine plates 11, 12 and expands in the direction perpendicular to them, keeping the flexible material 25 smooth across the back of the spine 10.

Figure 4:
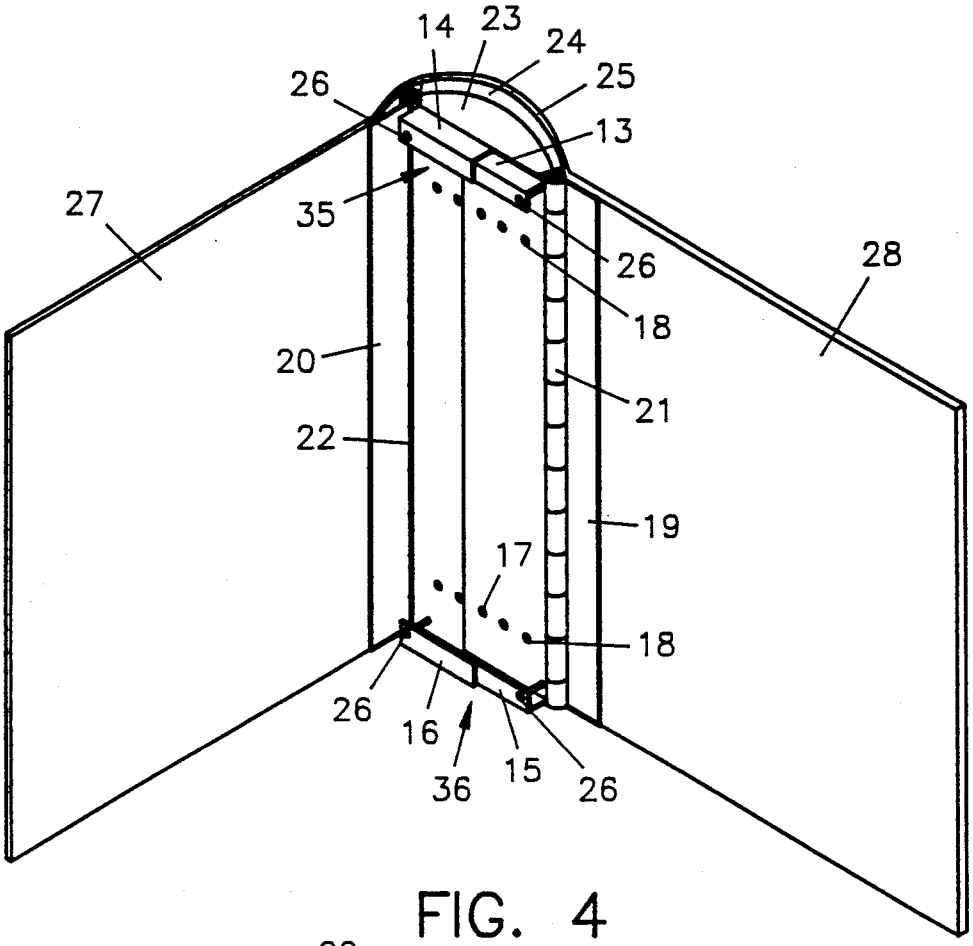
FIG. 4 is a view of the interior of the expandable loose-leaf album.

FIG. 4 shows a view of the interior of the loose-leaf photograph album. The front cover 27 and a back cover 28 of the album are hinged to the spine 10 so the album can be opened up flat for viewing. In the preferred embodiment, the hinging means is a pair continuous hinges 19, 20 of the type known as piano hinges, which are made integral with the spine plates 11, 12. The front and back covers 27, 28 of the album are made of a relatively stiff material, such as plastics, metals, fibrous materials, wood or wood laminates that are suitable for the covers.

The preferred embodiment includes a page retaining means which comprises a pair of channel members 35, 36 on the top and bottom of the spine 10. Each of the channel members 35, 36 includes an inner channel 13, 15 and an outer channel 14, 16 that move in sliding relation to one another. The inner channels 13, 15 are attached to one of the spine plates 11, and outer channels 14, 16 are attached to the other spine plate 12 so that when the spine 10 is adjusted, the channel members 35, 36 telescope to the proper length to match the desired width of the spine 10. Preferably, the channel members 35, 36 are formed integrally with the spine plates 11, 12, as shown. Alternatively, the channel members 35, 36 may be formed separately and attached to the spine plates 11, 12 by suitable means. The spine plates 11, 12 and the channel members 35, 36 may be made of sheet metal or plastic or other suitable materials that are rigid enough to support the weight of the pages.

Figure 5:
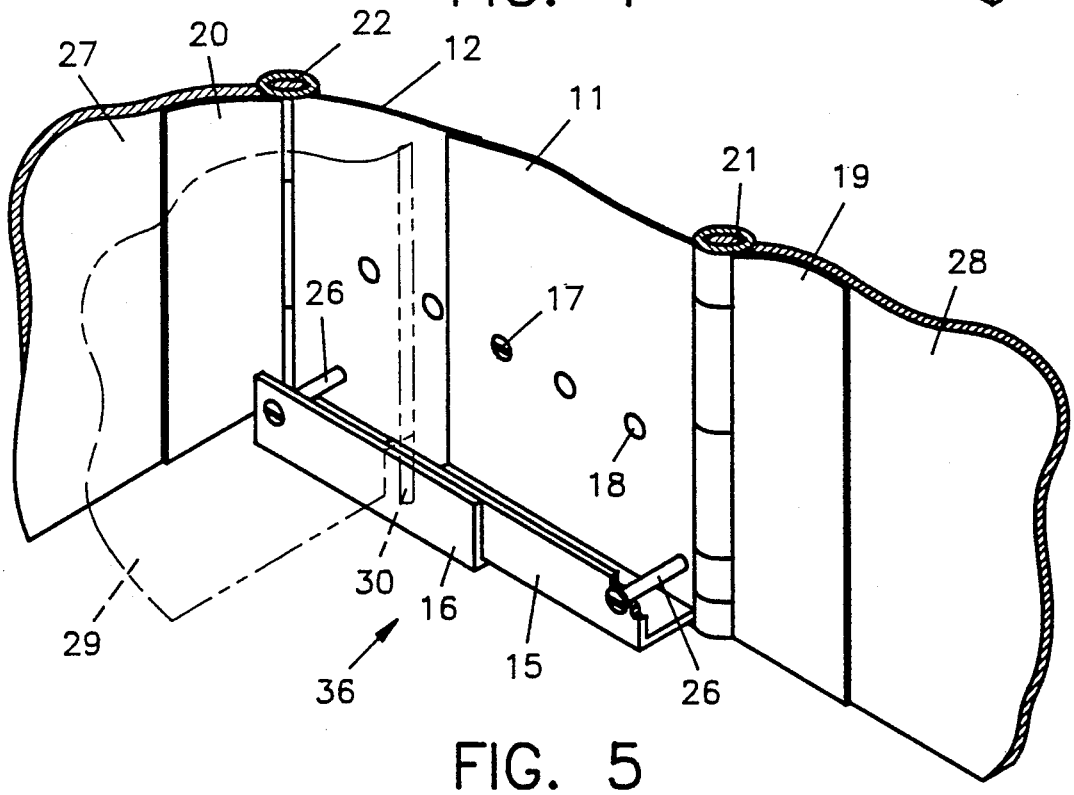
FIG. 5 is a detail drawing of the page retaining means.

FIG. 5 shows how a loose-leaf page insert 29 is held in the album by inserting the hinge rod 30 into the channel member 36. An opening 38 at the end of the channel member 36 allows the hinge rods 30 to be inserted or removed. A closure means 26 is provided to close off the opening 38 in the end of the channel member 36. The closure means in the preferred embodiment is a removable pin or set screw 26 which closes the end of the channel 36 so that the hinge rods 30 will be contained within the channel 36. Other suitable closure means may be used in place of the set screws 26 to close the ends of the channel members 36.

Figure 6:
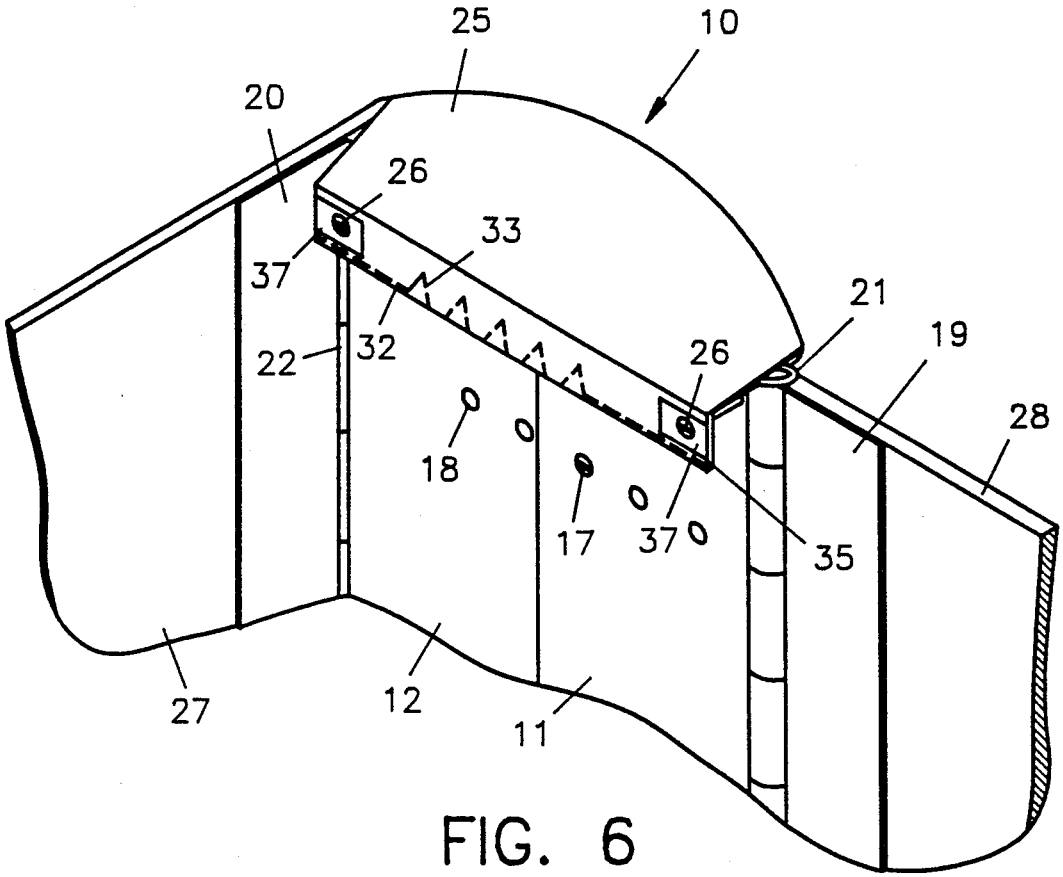
FIG. 6 is a detail drawing of the end of the expandable spine shown in an expanded position.
Figure 7:
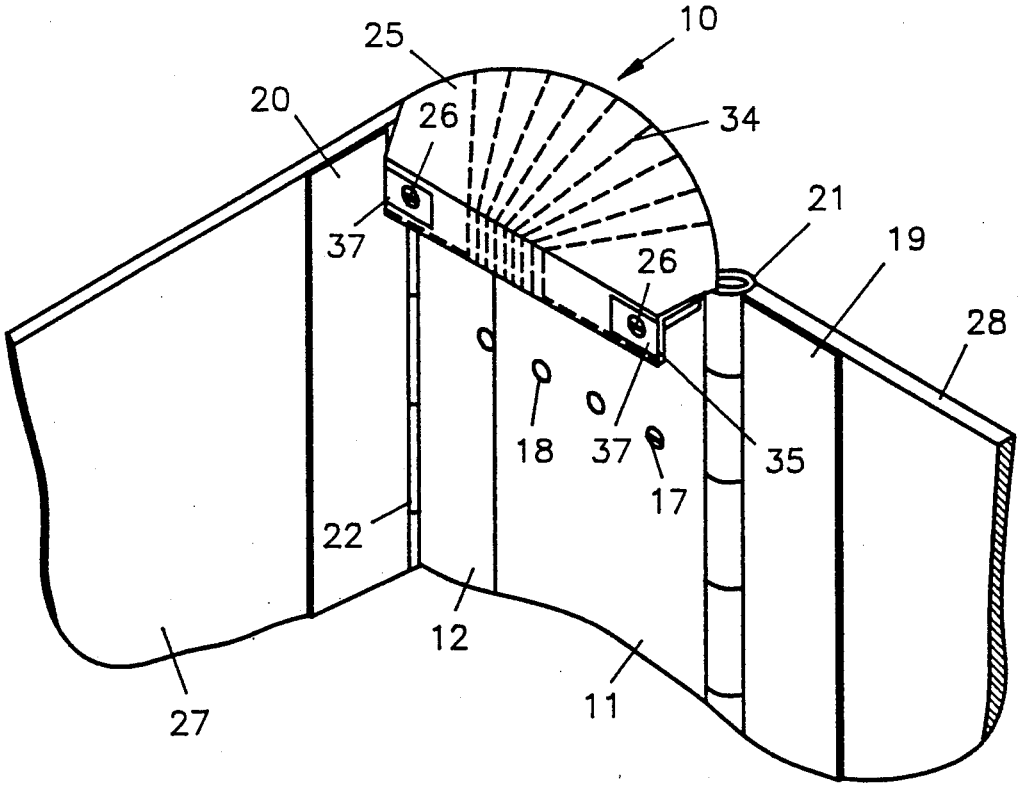
FIG. 7 is a detail drawing of the end of the expandable spine shown in a contracted position.

Another feature of the preferred embodiment is shown in FIGS. 6 and 7. A decorative end panel 34 is formed by an extension of the flexible material 25 which wraps around the ends of the spine 10 to cover the channel members 35 so that the inside of the album is as aesthetically pleasing as the outside. In order to accommodate the telescoping action of the channel members 35, the flexible material 25 must be made expandable where it covers the channels 35. This is done by gathering the material 25 and sewing it to a piece of elastic 31. The preferred method is to stretch a piece of elastic 31, preferably woven elastic, an appropriate amount and to sew it to the edge of the flexible material 25 with a seam 32 that has a zigzag section 33 in the center of it, as can be seen in FIG. 7. The edge of the flexible material 25 with the elastic 31 attached is folded over the edge of the channel 35 and held in place with tabs 37 with a hook-and-loop fastener, such as Velcro TM, attached. In place of or in addition to the hook-and-loop tabs 37, the pins or set screws 26 that close the ends of the channel members 35 may also serve to attach the edge of the flexible material 25 to the channel members 35. Alternatively, the elastic 31 may be folded over and sewn into a pocket shape which is hooked over the edge of the channel 35 to keep it in place. When the spine 10 is at its greatest expansion the flexible material 25 is smooth across the end of the album as shown in FIG. 6. Then, when the spine is compressed, as in FIG. 7, the elastic 31 contracts, and the flexible material 25 gathers along the zigzag portion 33, resulting in a very attractive sunburst pattern on the end panel 34 which contributes to the aesthetics of the album.

Figure 8:
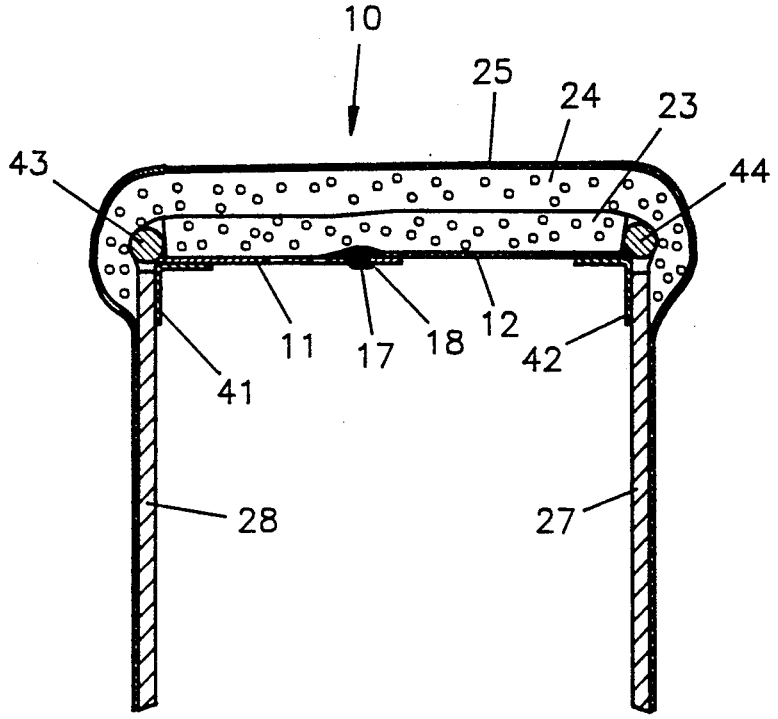
FIG. 8 shows a cross section of an alternate embodiment of the expandable spine in an expanded position.
Figure 9:
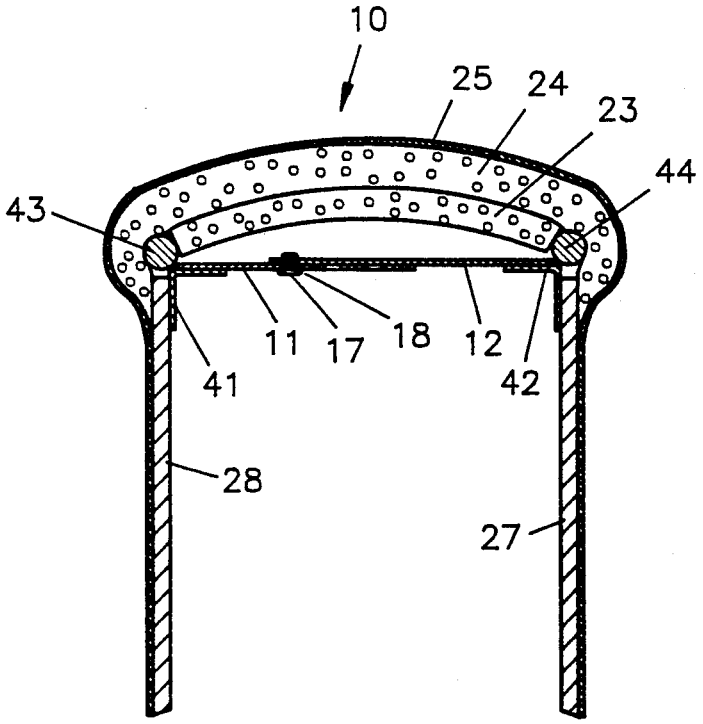
FIG. 9 shows a cross section of an alternate embodiment of the expandable spine in a contracted position.

Many other embodiments of the present invention are possible. One such alternate embodiment is shown in FIGS. 8 and 9. In this embodiment, the spine 10 is made up of two overlapping spine plates 11, 12 which slide over one another to allow the spine 10 to expand and contract. The plates 11, 12 are locked together at the desired width by one or more recessed screws 17 that fasten the two overlapping spine plates 11, 12 to one another through a series of spaced apart holes 18.

Along the back of the spine 10 is a layer of plastic foam 23 or other resilient material that has a constant thickness. Over the plastic foam 23 is a layer of foam or fiberfill padding 24 which is covered by the flexible material 25 to form a continuous surface across the back of the spine 10. When the spine 10 is fully expanded, as in FIG. 8, the plastic foam 23 lies flat against the spine plates 11, 12 and the flexible material 25 is smooth and relatively straight across the back of the spine 10. When the width of the spine 10 is contracted, as in FIG. 9, the foam 23 bows outward from the spine plates 11, 12 forming an arch. The padding 24 and the flexible material 25 bow outward conforming to the arch in the foam 23 which keeps the flexible material 25 smooth across the back of the spine 10.

If desired, the flexible material 25 which covers the spine 10 may be extended to also cover the front and back covers 27, 28 of the album or it may partially cover them to form what bookbinders call a half binding or quarter binding. Other details of the bookbinder's art such as raised ribs or French grooves may be added to enhance the bound book appearance of the album. The album may be further embellished with toolwork, printing, inlays or other decorative features.

The piano hinges of the preferred embodiment have been replaced by a pair of living hinges 41, 42 made of polypropylene or another flexible material which joins the front and back covers 27, 28 to the spine plates. Alternately, a plurality of smaller hinges may be used in place of the living hinges. If desired, a cylindrical piece such as a dowel 43, 44 may be added to each side of the spine 10 to maintain the appearance of a piano hinge. This is done because it has been found that the cylindrical protuberances of the piano hinges in the preferred embodiment help to hold the resilient material 23 in place and actually contribute to the bound book appearance of the finished album.

Other alternate embodiments of the spine may use an expansion means other than two overlapping spine plates. For example, the spine plates 11, 12 may be joined with a sliding attachment that does not require them to be overlapping or multiple spine plates may be used or the spine may have accordion pleats or other means that allow it to expand or the individual page inserts may have portions that combine together to form an expanding spine. Any of these expansion means could be combined with the resilient material 23 and the flexible material 25, as described above, to form an expandable spine that has the appearance of a bound book.

Figure 10:
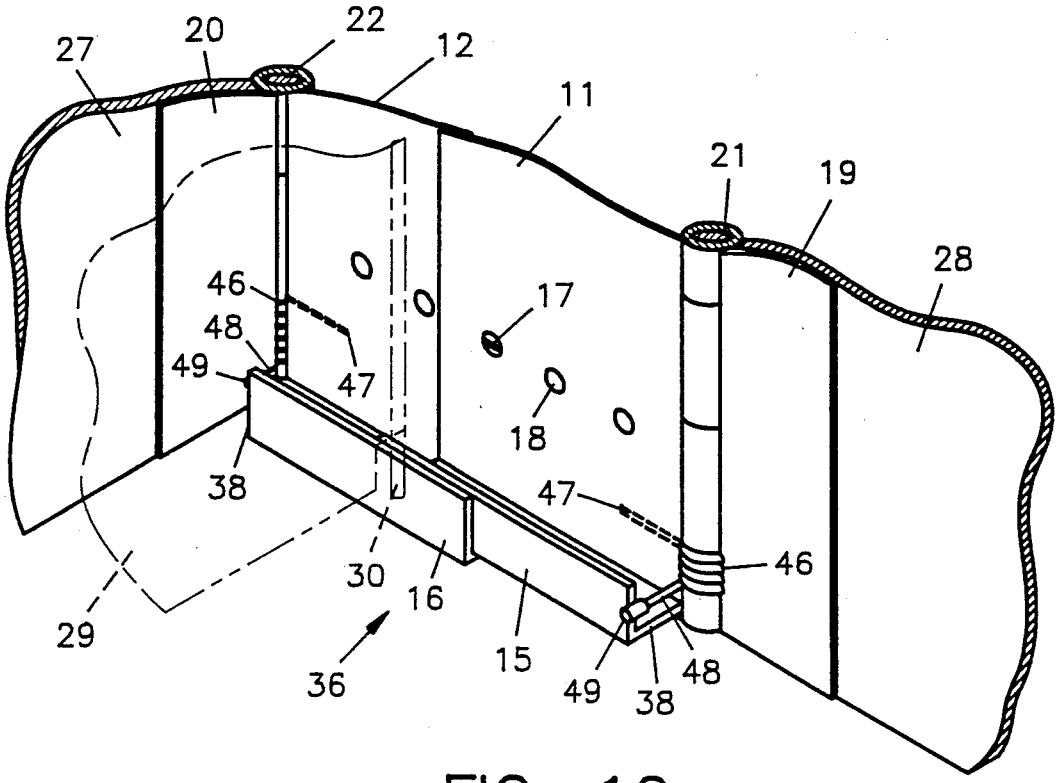
FIG. 10 is a detail drawing of an alternate embodiment of the page retaining means.

An alternate embodiment of the page retaining means is shown in FIG. 10. In this embodiment, the openings 38 at the ends of the channel member 36 each have a closure that is made from a torsional spring 46. The coil of the spring 46 wraps around the hinge pin 21, 22 of the piano hinge. One end 47 of each spring 46 extends behind the spine plates 11, 12 and the springs 46 are biased so that the other ends 48 of the springs 46 bear against the ends of the channel 36 with sufficient force to prevent the hinge rods 30 of the page inserts 29 from escaping the channel 36. A decorative cap 49 may be added to the end of the spring to facilitate opening access to the channel 36 when the user desires to insert or remove pages 29.

Figure 11:
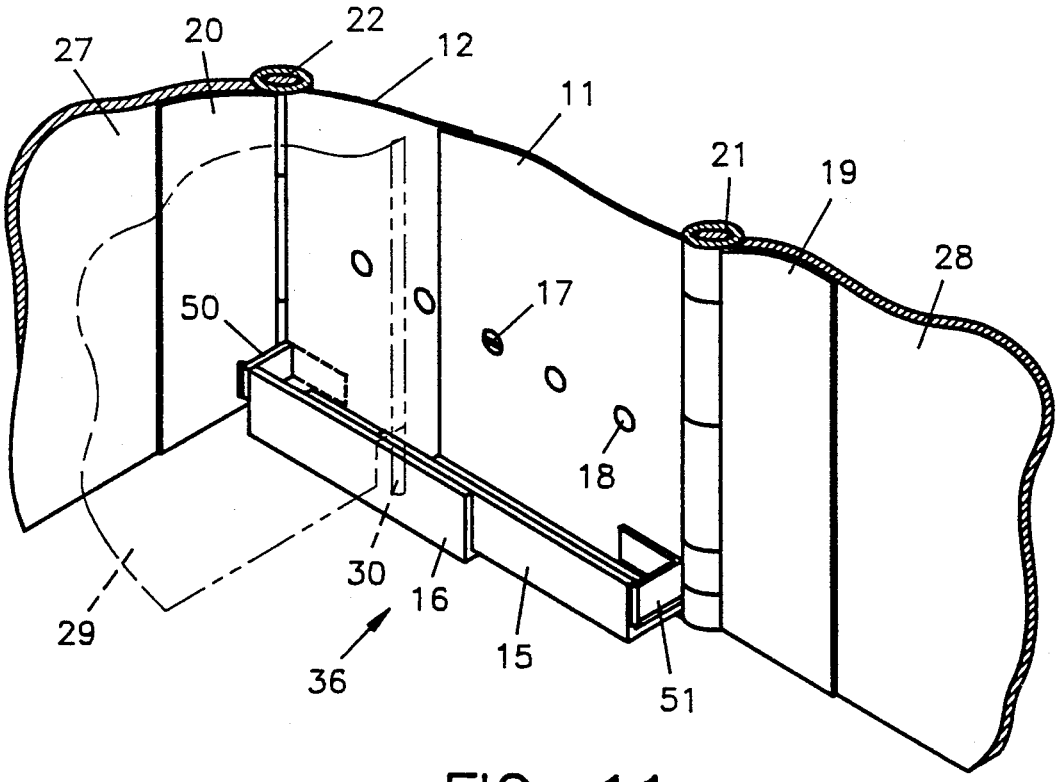
FIG. 11 shows another possible embodiment of the page retaining means.

Another possible embodiment of the page retaining means is shown in FIG. 11. A pair of L-shaped springs 50, 51 serve as closures at the ends of the channel member 36. Each of the springs 50, 51 is formed from a flat piece of spring steel and attached to the spine plates 11, 12 by spot welding or other suitable means. On the inner channel 15 the end of the flat spring 51 is fastened to the front of the spine plate 11, while on the outer channel 16, the spring closure 50 is fastened to the back of the spine plate 12 so the springs 50, 51 do not interfere with the sliding action of the spine plates 11, 12. The springs 50, 51 are biased so that they bear against the ends of the channel 36 with sufficient force to prevent the ends of the springs 50, 51 extend slightly beyond channel 36 and have a rolled edge to allow easier gripping of the springs 50, 51 for opening access to the channel 36 when the user desires to insert or remove pages 29.

CONCLUSION, RAMIFICATIONS AND SCOPE

In conclusion, it can be seen that the present invention provides an expandable spine for use with loose-leaf albums and binders that allows the user to adjust the capacity to match the volume of the contents, and that it accomplishes this while maintaining the outward appearance of a bound book at any state of expansion. While a preferred embodiment of the invention has been described in great detail, the details given should be interpreted merely as examples and not as limitations on the scope of the invention. Many variations are possible within the scope of the invention. For instance, in alternate embodiments of the invention other page retention means may be substituted for the means that have been described. Other possible retention means include expandable ring binders, post binders with telescoping or semicylindrical posts that allow for expansion, clamping mechanisms or other types of page retainers. Each of these means may be combined with the present invention to provide an expandable binder that has a bound book appearance. Also, while the present invention was conceived primarily for the storage and display of photographs and other visual materials, the inventor envisions many other possible uses of the invention. For instance, an album or binder incorporating the present invention may be used for storing other materials such printed matter, phonograph records, compact disks, computer disks or memorbilia.

Thus, the scope of the invention should be determined by the appended claims and their legal equivalents rather than by the examples given.

I claim:

1. An expandable spine, comprising:

an expansion means for increasing and decreasing the width of said spine, one or more layers of a resilient material overlying said expansion means, and a flexible material which forms a continuous surface overlying said resilient material, wherein said resilient material expands in a direction parallel to said spine and contracts in a direction perpendicular to said spine when the width of said spine is increased, and said resilient material contracts in a direction parallel to said spine and expands in a direction perpendicular to said spine when the width of said spine is decreased, such that said flexible material always forms a continuous surface over said resilient material regardless of the width of said spine.

2. The spine of claim 1 further comprising a page retaining means attached to said expansion means for removably attaching pages to said spine.

3. The spine of claim 2 wherein the page-holding capacity of said page retaining means increases and decreases in relation to the width of said spine.

4. The spine of claim 1 wherein said expansion means comprises a first spine plate and a second spine plate which move together in sliding relation.

5. The spine of claim 4 further comprising a locking means for controllably preventing said first spine plate and said second spine plate from moving in relation to one another.

6. The spine of claim 4 further comprising:

a first channel member attached to said first spine plate proximate one end of said first spine plate and a second channel member attached to said first spine plate proximate the opposite end of said first spine plate and a third channel member attached to said second spine plate proximate one end of said second plate and a fourth channel member attached to said second spine plate proximate the opposite end of said second spine plate, whereby, when said first spine plate is moved in sliding relation to said second spine plate, said first channel member and said third channel member move together in a telescoping manner and said second channel member and said forth channel member move together in a telescoping manner.

7. The spine of claim 6 further comprising one or more page members having a rod attached to one edge of said page member, said page members being removably attached to said spine by inserting the ends of said rod into said channel members.

8. The spine of claim 7 further comprising an opening in one or more of said channel members to allow the insertion of said ends of said rods into said channel members.

9. The spine of claim 8 further comprising a closure means for each of said openings in said channel members so that said ends of said rods will be retained in said channel members.

10. The spine of claim 1 further comprising a front cover hinged to one edge of said spine and a back cover hinged to the opposite edge of said spine.

11. The spine of claim 10 further comprising a decorative inlay inset into said front cover.

12. An expandable volume, comprising:

an expandable spine which comprises, a first spine plate and a second spine plate which move together in sliding relation for increasing and decreasing the width of said spine, one or more layers of a resilients material overlying said first spine plate and said second spine plate, and a flexible material which forms a continuous surface overlying said resilient material, wherein said resilient material expands in a direction parallel to said spine and contracts in a direction perpendicular to said spine when the width of said spine is increased, and said resilient material contracts in a direction parallel to said spine and expands in a direction perpendicular to said spine when the width of said spine is decreased, such that said flexible material always forms a continuous surface over said resilient material regardless of the width of said spine, and a page retaining means which comprises, a first channel member attached to said first spine plate proximate one end of said first spine plate and a second channel member attached to said first spine plate proximate the opposite end of said first spine plate and a third channel member attached to said second spine plate proximate one end of said second spine plate and a fourth channel member attached to said second spine plate proximate the opposite end of said second spine plate, whereby, when said first plate is moved in sliding relation to said second spine plate, said first channel member and said third channel member move together in a telescoping manner and said second channel member and said forth channel member move together in a telescoping manner.

13. The expandable volume of claim 12 further comprising one or more page members having a rod attached to one edge of said page member, said page members being retained in said album by inserting the ends of said rod into said channel members.

14. The expandable volume of claim 13 further comprising one or more openings in said channel members to allow the insertion of said ends of said rods into said channel members.

15. The expandable volume of claim 14 further comprising a closure means for each of said openings in said channel members so that said ends of said rods will be retained in said channel members.

16. The expandable volume of claim 12 further comprising a front cover hinged to one edge of said spine and a back cover hinged to the opposite edge of said spine.

17. The expandable volume of claim 16 further comprising a decorative inlay inset into said front cover.

18. An expandable volume comprising:

an expandable spine which comprises, a first spine plate and a second spine plate which move together in sliding relation for increasing and decreasing the width of said spine, and a page retaining means which comprises, a first channel member attached to said first spine plate proximate one end of said first spine plate and a second channel member attached to said first spine plate proximate the opposite end of said first spine plate and a third channel member attached to said second spine plate proximate one end of said second spine plate and a fourth channel member attached to said second spine plate proximate the opposite end of said second spine plate, whereby, when said first spine plate is moved in sliding relation to said second spine plate, said first channel member and said third channel member move together in a telescoping manner and said second channel member and said forth channel member move together in a telescoping manner.

19. The expandable volume of claim 18 further comprising one or more page members having a rod attached to one edge of said page member, said page members being retained in said album by inserting the ends of said rod into said channel members.

20. The expandable volume of claim 18 further comprising:

an opening in one or more of said channel members, and a closure means for each of said openings in said channel members.

* * * * *